United States Patent [19]

Davidson

[11] Patent Number: 4,974,343

[45] Date of Patent: Dec. 4, 1990

[54] FOOT SUPPORT AND CUSHIONING DEVICE

[76] Inventor: Murray R. Davidson, P.O. Box 759, San Marcos, Calif. 92069

[21] Appl. No.: 316,643

[22] Filed: Feb. 28, 1989

[51] Int. Cl.[5] ..... A43B 7/32; A61F 5/00

[52] U.S. Cl. ..... 36/89; 36/37; 128/80 H; 128/166

[58] Field of Search ..... 36/89, 88, 93, 37, 96; 128/166, 80 H, 165

[56] References Cited

U.S. PATENT DOCUMENTS

| | | | |
|---|---|---|---|
| 2,165,879 | 7/1939 | Wilkinson | 128/166 |
| 3,028,861 | 4/1962 | Shapiro | 36/89 |
| 3,970,083 | 7/1976 | Carrigan | 36/89 |
| 4,089,586 | 4/1978 | Hettick | 128/80 H |
| 4,166,460 | 9/1979 | Applegate | 128/166 |
| 4,179,826 | 12/1979 | Davidson | 36/37 |
| 4,313,433 | 2/1982 | Cramer | 128/166 |
| 4,325,380 | 4/1982 | Malkin | 36/37 |
| 4,621,698 | 11/1986 | Ivany | 36/89 |
| 4,729,370 | 3/1988 | Kallassy | 128/166 |
| 4,753,228 | 6/1988 | Selner et al. | 36/89 |

FOREIGN PATENT DOCUMENTS

| | | | |
|---|---|---|---|
| 279735 | 10/1925 | Fed. Rep. of Germany | 128/80 H |

*Primary Examiner*—Steven N. Meyers

*Attorney, Agent, or Firm*—Gregory J. Nelson

[57] ABSTRACT

An ankle supporting and foot cushinoning device including a stretchable ankle having a tubular body fitting over at least a portion of the foot of the wearer and extending around the heel area to the ankle area. A heel cup is attached to the anklet having a resilient body which defines a recess to receive the heel portion of the foot of the wearer. The body is provided with shock absorbing means in at least an area adjacent to the os calcis portion of the wearer's foot whereby the ankle is supported and properly maintains the heel cup in a controlled position to absorb shock.

10 Claims, 1 Drawing Sheet

FOOT SUPPORT AND CUSHIONING DEVICE

BACKGROUND OF THE INVENTION

The present invention relates to a foot cushioning device and more particularly relates to a support and cushioning device which is securable about the ankle and foot of the user which has a shock-absorbing structure to absorb and relieve shock imposed on the root particularly in the heel area and which incorporates an elastic anklet.

The anatomical structure of the foot is generally in the form of a tripod with the weight of the person supported at the heel and the head of the first and fifth metatarsal bones. Forces applied at these points are substantial and various conditions or disorders can result from the application of these forces. These conditions include apophysitis which is an inflamation of the achilles tendon at the point where the tendons join the underside of the os calcis. Other disorders can be caused or aggravated by forces applied at the weight-bearing portions of the foot. These conditions can be particularly severe in physically active people such as joggers, gymnasts and the like.

Various devices can be found in the prior art which are corrective foot appliances to alleviate toot disorders resulting from excessive force. Generally these devices are orthopaedic appliances to alleviate conditions such as shock and to maintain the heel and the foot in the proper anatomical attitude to prevent the tendency of the foot to pronate. Most of these prior art devices are intended to be inserted in some type of footwear. One such device is shown in my prior patent, U.S. Pat. No. 4,619,055, which discloses a cushioning pad or mat which is insertable in footwear having an upper laminae of material having moisture-absorbent characteristics, an intermediate laminae, and a lower cushioning pad. When used as an insole, the insole is provided in various sizes and shapes for insertion in shoes. Air holes are provided at spaced intervals and a special cellular design provides a bellows action to enhance flow of air around and through the insole and also serves to improve blood circulation to the extremities of the user.

Another foot cushioning device is also shown in my prior patent, U.S. Pat. No. 4,179,826. This device, which has achieved considerable commercial success, is sold under the trademark TULI'S and has a body defining a cup-like recess to receive at least the heel or os calcis portion of the foot. The device is insertable in ordinary footwear. The exterior of the body carries shock absorbing projections extending from at least the rear of the heel portion at the underside of the foot. The projections deform and deflect to protect the foot by absorbing shock forces on the weight-bearing portions of the foot.

While as indicated above, the aforementioned devices nave achieved considerable commercial success, there are particular applications where the user is in need of the benefits of a shock absorbing device independent of footwear or where the user also requires some physical support of a portion of the foot or ankle.

Some individuals have a condition which is commonly known as weak ankles and to treat this condition wear an ankle support or wrap of some type. Participants in various types of athletic endeavors, both professionally and recreationally, also feel the need for an ankle support device. An ankle support may offer additional reinforcement, both psychologically and physiologically, when worn without a shoe. Also, individuals who find it necessary in activities to stand for a long period of time suffer from pooling of blood in the ankles or edema, find an ankle wrap helps to prevent this condition.

As indicated above, many athletes nave special problems Gymnasts engaged in vaulting, tumbling and other gymnastic routines, often land on their feet and particularly on their heels with substantial shock. As a number of investigations nave found, striking the heels on hard surfaces causes damage and pain to the individual. Gymnasts, vaulters and acrobats cannot wear shoes because of the requirement for precise foot control and tactile sensation during exercises or on bars and beams. The participant's feet need to engage the bars with an unimpeded forefoot, toe and ballfoot gripping effect.

Accordingly, there exists a need for a foot cushioning device which serves to absorb shock imposed from the foot and heel of the individual and which can be used independent of footwear and which will also serve to provide ankle support to the user.

SUMMARY OF THE INVENTION

Briefly, the present invention provides a novel and unique foot cushioning device which includes a heel cup designed to fit over the heel area of the wearer. The heel cup is formed from a relatively soft, flexible material such as molded rubber or other thermoplastic material. The exterior of the heel cup in the area beneath the os calcis is provided with projecting shock absorbing members. The shock absorbing members may be formed in various configurations such as semi-circular projections, disk-like projections or intersecting ribs. The heel cup is attached to an elastic support anklet which is generally L-shaped adapted to be worn over the ankle area and a portion of the foot area of the user. The anklet is preferably constructed of an expandable elastic material and may be a synthetic or natural rubber which serves to support the ankle area of the user and to secure the shock absorbing heel cup in the proper position. The device of the present invention provides a complete rear foot appliance which controls the pronation and supination of the heel and stabilizes the ankle. The device is also helpful in controlling edema and the shock absorbing heel cup serves to deform to absorb shock upon impact. The device leaves a substantial portion of the user's foot free so the device may be used by gymnasts and other athletes where a high degree of tactile sensitivity is required. The device is also helpful in maintaining the proper position of the heel cup at the heel of the wearer in footwear which does not easily lend itself to the insertion of a separate heel cup such as high top boots.

The above and other objects and advantages of the present invention will be more readily apparent from the following specification, claims and drawings in which:

DETAILED DESCRIPTION OF THE INVENTION

As is well known, the skeletal structure of the human foot and ankle includes the lower portion of the tibia and the os calcis or heel bone. The talis is positioned above the os calcis and below the tibia. The forward bone structure of the foot includes the cuboid and metatarsal bones extending forwardly from the cuboid. Generally in the anatomically correct foot, body weight is supported at three points: two weight-bearing portions on the forward part of the foot in the metatarsal area and the other weight-bearing portion being on the bottom of the foot below the os calcis. Running, jumping and even walking often impose heel strike forces of substantial magnitude on the os calcis which are transmitted to the joint structure of the individual. Also, various activities can impart undesired pronation of the foot which is a twisting motion which can cause damage to the ligaments and tendons.

Figure 1:
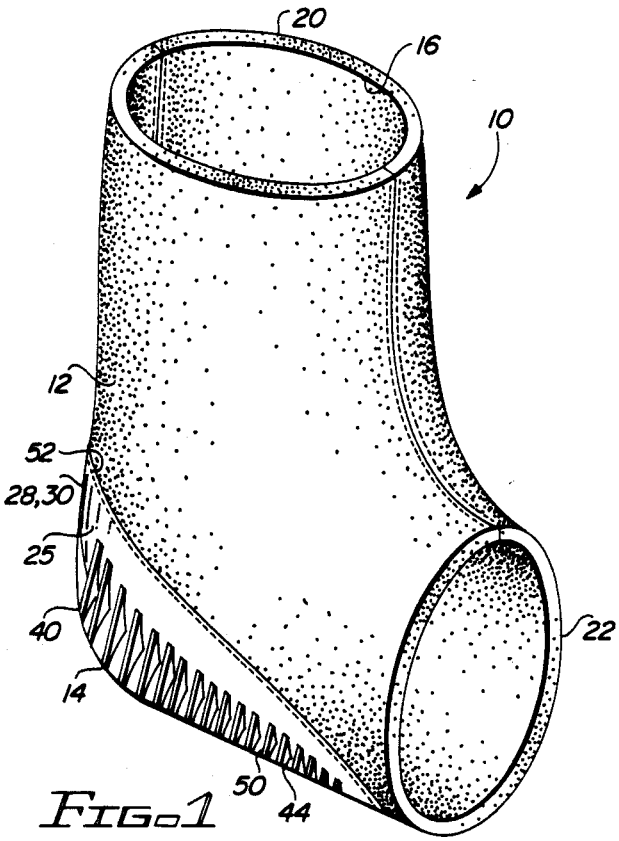
FIG. 1 is a perspective view of the support and cushioning device of the present invention.
Figure 2:
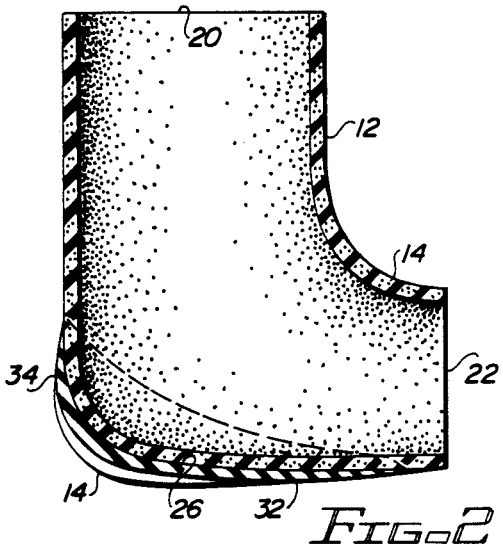
FIG. 2 is a longitudinal sectional view of the cushioning and support device of the present invention.

The present invention relates to a support and shock absorbing device the preferred embodiment of which is shown in FIGS. 1 and 2 and is generally designated by the numeral 10. Support and cushioning device 10 is designed to fit snugly about the ankle area of the user and includes an anklet portion 12 and a shock absorbing member 14. Anklet 12 is generally tubular defining an interior opening 16 which receives the foot and ankle of the wearer. The upper edge 20 of the anklet preferably extends to an area at least above the ankle bone of the wearer. The anklet is a generally tubular member extending downwardly conforming to the general shape of the foot of the user in an L-shape. The anklet terminates at a forward edge 22 which, as shown in FIGS. 1 and 2, corresponds to a location generally corresponding to the cuboid bone. The anklet is preferably constructed from a stretchable material. Appropriate materials such as natural latex rubber and expanded neoprene of the type commonly used in such applications as diver's wetsuits are suitable for this purpose. The materials of fabrication of the anklet may vary but the main characteristic of the material is tnat the material should nave elastic properties so tnat the material will stretch to snugly engage the foot of the wearer to provide suitable support. The material may also be a laminate material with suitable laminations to allow the material to properly breath, absorb moisture and resist wear. In some cases a stretchable sock or stocking may be suitable.

The anklet is provided with a shock absorbing member 14 which is formed having a cup-like body 25. The cup-like body 25 has an interior heel-receiving recess 26 defined by opposite side walls 28 and 30, platform 32 and generally vertical rear wall 34. Shock absorbing or cushioning means 40 are provided on the exterior surface of the cup-like body. The shock absorbing means as shown in FIGS. 1 and 2 consist of a plurality of spaced-apart parallel ribs 44 extending longitudinally along the exterior of the rear wall and continuing along the bottom side of the platform. Preferably the depth of the longitudinal ribs decrease from a maximum depth in the heel area to a minimum near the forward and rearward terminus of the ribs. The number and spacing of the ribs may vary but should extend substantially the full width of the os calcis.

Transverse ribs 50 intersect the longitudinal ribs 44 at spaced intervals forming a plurality of generally rectangular shock absorbing sections 34 having a waffle-like appearance. Shock forces imparted during walking, running or other activities are absorbed by deflection or deformation of the ribs. After deflection, the ribs return to their normal, nondeflected stare. Preferably, the shock absorbing heel cup is molded as an integral unit from appropriate light-weight material such as natural latex rubber, neoprene or low-density thermoplastic material such as polypropylene or polyethylene. The particular materials and fabrication may vary but the particular material should be resilient and have memory so tnat after the material has deformed it returns to its original shape or condition.

The shock absorbing heel cup member 14 is attached to the anklet member by an appropriate adhesive or by sewing operations as shown with a seam 52 extending peripherally about the edge of the heel cup.

Figure 3:
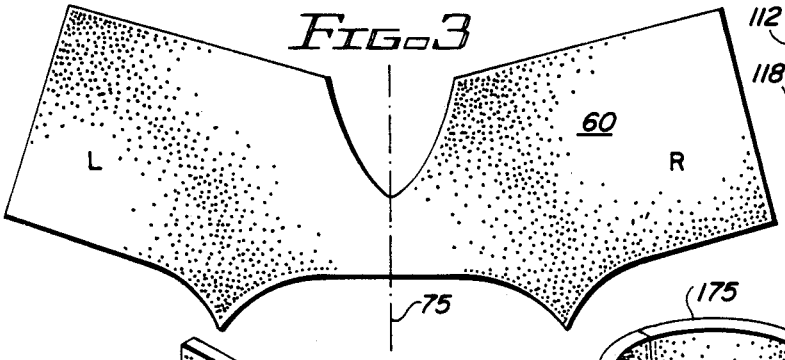
FIG. 3 is a plan view of the ankle supporting anklet in a flattened condition prior to assembly.
Figure 4:
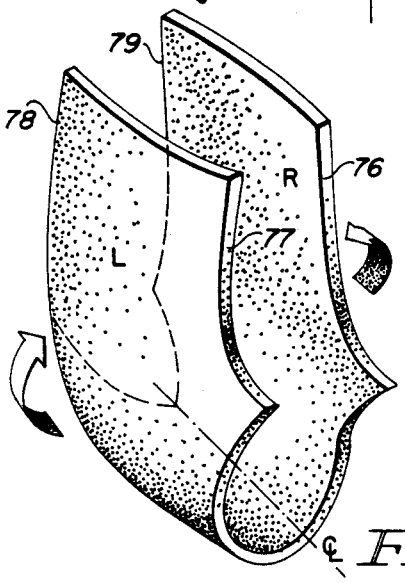
FIG. 4 illustrating the fabrication of the anklet prior to attachment of the heel cushion.

The anklet 12 similarly may be formed as a one piece unit or fabricated in a sewing operation. Referring to FIGS. 3 and 4, the fabrication and assembly of the support and cushioning device is shown. Numeral 60 illustrates a piece of the material or fabric which forms the anklet 14 which has been cut to the desired shape. Piece 60 has a right hand portion designated by the numeral "R" and a left hand portion designated by the letter "L". FIG. 3 illustrates the piece with the inner side of the anklet disposed towards the viewer. The anklet is assembled as shown in FIG. 4 with the right and left portions being folded about fold line 75 and brought in juxtaposition. Front edges 76 and 77 are joined by a bonding or sewing operation. Similarly, the rear edges 78 and 79 are similarly joined completing the tubular structure with an opening 80 to allow a portion of the foot to extend forwardly from the anklet. Opening 16 at the upper edge of the anklet is received about the ankle of the wearer. Heel cup 14 may then be attached at the heel area of the anklet by bonding or sewing operation as described.

In use, the toe of the user's foot is inserted in the upper end of opening 16 of the anklet portion of the device. The upper edge 20 of the anklet is grasped and pulled upwardly so tnat the device assumes a position about the ankle and a portion of the foot of the user with the user's heel firmly seated in the area of the heel cup area of the cushioning and support device. The platform 32 of the heel cup extends from at least below the os calcis portion of the wearer's foot forwardly. The heel cup also extends rearwardly up the rear of the heel and medially and laterally along the sides of the heel portion. A portion of the wearer's foot projects forwardly from the front edge 22. The elasticized anklet provides support to the wearer and, as mentioned above, may also help to minimize swelling in the area of the ankle. Elastic anklet also holds the heel cup in the correct position at the heel of the user. The heel cup 14 serves to absorb shock forces imparted during walking or other activities by deflection and deformation of the ribs 44 and 50. After deflection, the ribs will return to their normal nondeflected state. The configuration of the device leaves a forward portion of the user's foot unimpeded for good tactile feel and toe and ball boot gripping as required in many athletic activities.

Figure 5:
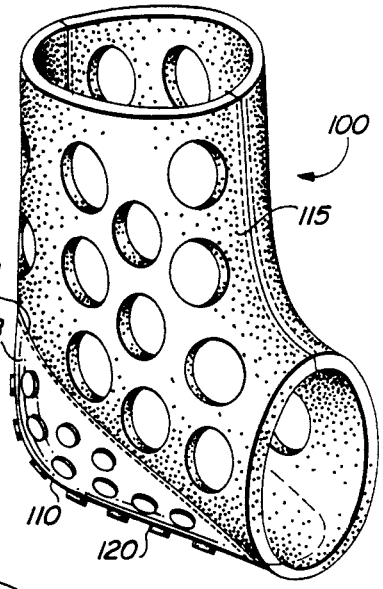
FIG. 5 is a perspective view of another embodiment of the foot cushioning and support device of the present invention.

FIG. 5 illustrates another embodiment of the present invention which is generally designated by the numeral 100. In this embodiment, the integrally molded heel cup 110 is formed generally as shown in FIGS. 1 and 2 having a cavity 112 secured in the heel area of the anklet 115. The exterior surface 118 of the heel cup carries a plurality of projections 120 which are shown in the form of circular generally thin disks of resilient material integrally formed. The projections are located and extend from the exterior of the heel cup in the area of the os calcis so tnat forces or shock imparted to the foot are absorbed by deflection and deformation of the shock absorbing members 120. Anklet 115 is again constructed having elastic characteristics to stretch and snugly engage the ankle and foot portion of the wearer. For the comfort of the user, a plurality of ventilation openings 125 are provided in the anklet at suitable locations.

Figure 6:
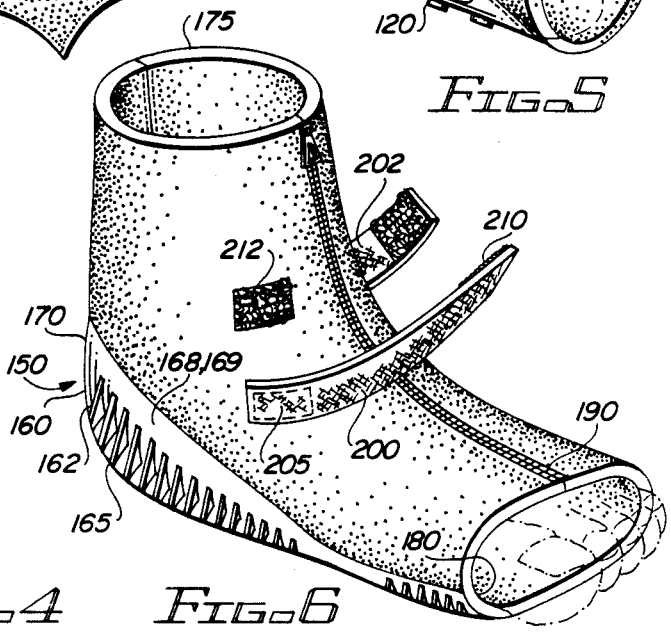
FIG. 6 is a perspective view of still another embodiment of the foot cushioning and support device of the present invention.

FIG. 6 illustrates still another form of the present invention generally designated by the numeral 150. The cushioning member 160 has a heel cup portion 162 which defines a recess to receive the heel portion of the elastic anklet 165. As discussed above, the weight of a person is supported generally at three points on the foot. The cushion member 160 as shown in FIG. 6 extends forwardly along the plantar surface of the anklet to serve to absorb shock and forces imposed on the metatarsal area as well as the heel area. Shock absorbing members 165 are provided along the underside of the platform and may be either ribs as shown or projections as described above. Preferably the shock absorbing members have the greatest depth in the area immediately below the os calcis. The shock absorbrng member also includes lateral and medial sides 168 and 169 extending at either side of the anklet 165. Counter or rear portion 170 extends upwardly along the rear of the anklet for added support.

The anklet is suitably fabricated from an elastic material as described above having upper edge 175 which extends in an area at or above the ankle bone of the user. The anklet curves forwardly having opening 180 at its forward end for the extension of the toes of the wearer from the anklet. The cushioning device as shown in FIG. 6 extends forwardly a sufficient distance to absorb shock and forces imposed on the metatarsal area of the foot as well as on the area immediately subjacent the os calcis. For convenience of representation, the shock absorbing means are shown as longitudinal and transverse ribs intersecting in a generally rectangular pattern. The cushioning device serves to snugly support the ankle and foot of the user and also maintains and secures the shock absorbing member in position at the heel and underside of the user's foot.

In some instances the anklet, such as the anklet 12 or the anklet 165 as shown in FIG. 6, may be so snug so as to be difficult for the user to pull over his or her foot. To facilitate engagement of the anklet about the foot, the anklet 165 may be provided with a placket-like opening and closure 190 to permit the anklet to be opened and placed on the foot and then closed in a snug position. Closure 190 is shown as a zipper extending centrally from the top 175 to the front opening along the top of the foot and front of the ankle. Other types of closure such as snaps or loop and nook fabric fasteners may be used for this purpose. The position of the closure may also be provided at other locations such as at the medial or lateral sides of the anklet.

As an added feature, the anklet 165 may be provided with auxiliary support in the form of straps 200 and 202 which are stitched or otherwise secured to the anklet at one end 205. The distal ends of the straps extend at least partially about the foot and ankle and are securable at mating fastener sections 210 on the strap and 212 at a predetermined location on the anklet. The user may position and tighten the straps to provide additional support as desired.

Thus, it will be seen tnat the present invention provides a simple, effective and unique support and cushioning device for the foot and the ankle of the user. Various forms and configurations of the shock absorber members associated with the heel cup body have been shown and it will be understood the present invention is not limited to any particular shape or configuration of these members. Those chosen were selected as being representative for purposes of illustration only. Various materials as indicated can be used in the construction of the anklet and the heel cup shock absorber attached thereto.

It will be apparent to those skilled in the art to make various changes, alterations and modifications to the present invention. To the extent that these changes, alterations and modifications do not depart from the spirit and scope of the appended claims, they are intended to be encompassed therein.

I claim:

1. An ankle supporting and foot cushioning device comprising in combination:

(a) an anklet having a generally tubular body with an upper and a forward end defining a foot-receiving opening to receive a portion of the foot of the wearer from the ankle to at least a location along the plantar surface and extending over a portion of the heel area, said anklet being of an elastic material and having a smooth interior free of obstructions to be worn adjacent the foot and ankle of the user;

(b) a heel cup having a resilient body having side walls, a rear wall, and a bottom wall defining a recess located in the heel area of said anklet, said heel cup body having exterior shock absorbing means associated therewith in at least the area adjacent the os calcis portion of the wearer's foot, said heel cup being exteriorly secured to said anklet at least about the peripheral edge of the heel cup to form an integral assembly therewith to snugly secure the heel cup to the heel portion of the wearer's foot whereby said anklet supports the wearer's ankle and said cup is maintained in a controlled position on the foot to absorb shock.

2. The device of claim 1 wherein said anklet body defines a second opening at the said forward end to permit projection therethrough of at least the wearer's toes.

3. The device of claim 2 wherein said anklet and heel cup extend a distance along the foot substantially conforming to the plantar surface of the foot and terminating in the metatarsal area of the foot.

4. The device of claim 1 wherein said shock absorbing means comprises first rib means extending on the exterior surface of said body and second rib means intersecting said first rib means to define a generally waffle-like pattern.

5. The device of claim 1 wherein said shock absorbrng means comprise generally circular projections extending from said body.

6. The device of claim 1 wherein said anklet is neoprene and said heel cup is molded rubber.

7. The device of claim 1 wherein said anklet is provided with vent openings.

8. The device of claim 1 wherein said anklet body is provided with a placket-like opening therein, said placket-like opening having a fastenable closure associated therewith.

9. The device of claim 8 wherein said closure comprises fabric loop and hook fastener members.

10. The device of claim 1 further including strap means attached to said anklet body having a free end, said free end being selectively securable to said body at a predetermined location for additional support.

* * * * *